United States Patent [19]

Ogura et al.

[11] Patent Number: 4,982,230

[45] Date of Patent: Jan. 1, 1991

[54] IMAGE FORMING APPARATUS WITH MEANS FOR DETECTING EXCESS DEVELOPER

[75] Inventors: Masahiko Ogura, Yokohama; Kazuhiro Ikemori, Kawasaki; Tatsuyuki Miura, Yokohama; Takahiko Adachi, Tokyo, all of Japan

[73] Assignee: Kabushiki Kaisha Toshiba, Kawasaki, Japan

[21] Appl. No.: 326,001

[22] Filed: Mar. 20, 1989

[30] Foreign Application Priority Data

Mar. 22, 1988 [JP] Japan ..... 63-67711
Jun. 30, 1988 [JP] Japan ..... 63-160896

[51] Int. Cl.[5] ..... G03G 21/00; G03G 15/00
[52] U.S. Cl. ..... 355/206; 355/298
[58] Field of Search ..... 355/298, 203, 204, 205, 355/206

[56] References Cited

FOREIGN PATENT DOCUMENTS 220915 5/1987 European Pat. Off. .
227488 7/1987 European Pat. Off. .
3235422 4/1983 Fed. Rep. of Germany .
62-288879 12/1987 Japan ..... 355/298

*Primary Examiner*—Joan H. Pendegrass
*Attorney, Agent, or Firm*—Foley & Lardner, Schwartz, Jeffery, Schwaab, Mack, Blumenthal & Evans

[57] ABSTRACT

An image forming apparatus includes a blade for removing a developer remaining or an image carrier and a recovering element for recovering the developer removed by the blade. The image forming apparatus further includes a generator for generating an electric signal corresponding to a change in a load acting on the recovering element in response to the amount of the developer and a monitor for monitoring the amount of the developer in accordance with the electric signal.

11 Claims, 11 Drawing Sheets

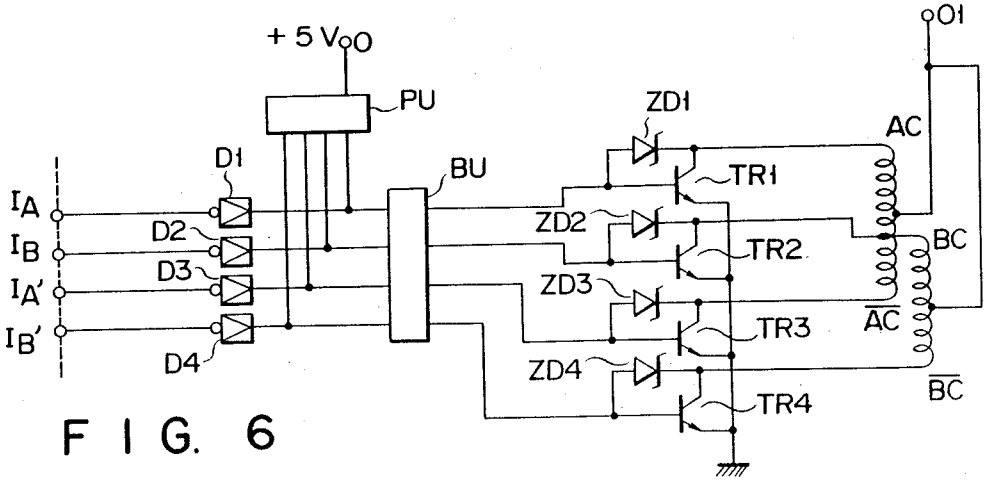
FIG. 6
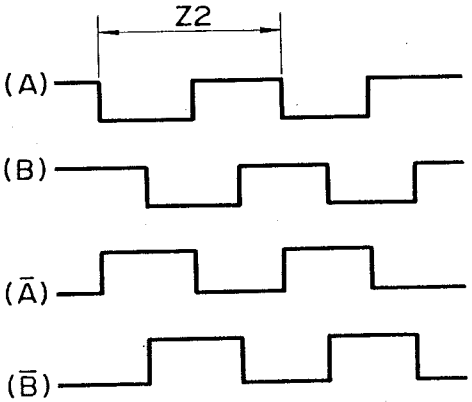
FIG. 7A
FIG. 7B
FIG. 7C
FIG. 7D

IMAGE FORMING APPARATUS WITH MEANS FOR DETECTING EXCESS DEVELOPER

BACKGROUND OF THE INVENTION

1. Field of the Invention

The present invention generally relates to an image forming apparatus, and, more particularly, to an image forming apparatus that electrically monitors the residual developers collected in a collecting box.

2. Description of the Related Art

In an image forming apparatus using electronic photographic technology, after forming an image, a developer remaining on an image-formed medium is normally removed by a blade for use in the next image forming process. The removed, residual developer is collected through a conveying screw in a collecting box. When the amount of the residual developers in the collecting box reaches the maximum collecting amount, it is displayed that the collecting box is full.

Conventionally, to detect that the amount of the residual developers reaches the maximum collecting amount, a micro switch is provided adjacent one end of the conveying screw so that it is turned ON when the conveying screw moves in the thrust direction at the time the collecting box becomes full of residual developers.

According to the above conventional detector, however, because of movement of the conveying screw allowed, a gap between the screw and a bearing section for supporting the screw cannot be sealed. Therefore, the developer is likely to leak from this gap. Further, since the movement of the conveying screw in the thrust direction is not constant, the level of detection will vary.

SUMMARY OF THE INVENTION

Accordingly, it is an object of this invention to provide an image forming apparatus that electrically monitors the amount of developers collected in a collecting box.

It is another object of the invention to provide a developer collecting means that senses and removes excess developer from an image forming apparatus.

It is a further object of the invention to provide an excess developer sensing means that terminates the image forming process until the excess developer is removed.

It is a still further object of the invention to provide an electrical sensing means for determining the presence of excess amount of developer in an image forming apparatus.

It is yet another object of the invention to provide a control system for detecting and removing excess developer from an image forming apparatus that includes an electrical detecting means and a spiral screw means responsive to the detecting means, the screw means transporting excess developer to a collecting element when activated by the detecting means.

Another object of the invention is to provide a method for detecting, by means of an electrical system, an excess amount of developer in an image forming apparatus and removing the excess amount by means of a detector actuated screw means.

To achieve these objects, there is provided an apparatus for forming an image on an image carrier using a developer supplied from a developing section, the apparatus comprising:

means for removing the developer remaining on the image carrier;

means for recovering the developer removed by the removing means;

means for generating an electric signal corresponding to a change in a load acting on the recovering means in response to an amount of the developer recovered by the recovering means; and means for monitoring the amount of the developer recovered by the recovering means, in accordance with the electric signal generated by the generating means.

BRIEF DESCRIPTION OF THE DRAWINGS

FIG. 6 is a circuit diagram of a driver of the pulse motor shown in FIG. 4;

FIGS. 7A to 7D are waveforms of excitation signals supplied to the motor driver shown in FIG. 6;

DETAILED DESCRIPTION OF THE PREFERRED EMBODIMENT

Preferred embodiments of this invention will be described below with reference to the accompanying drawings.

Figure 1:
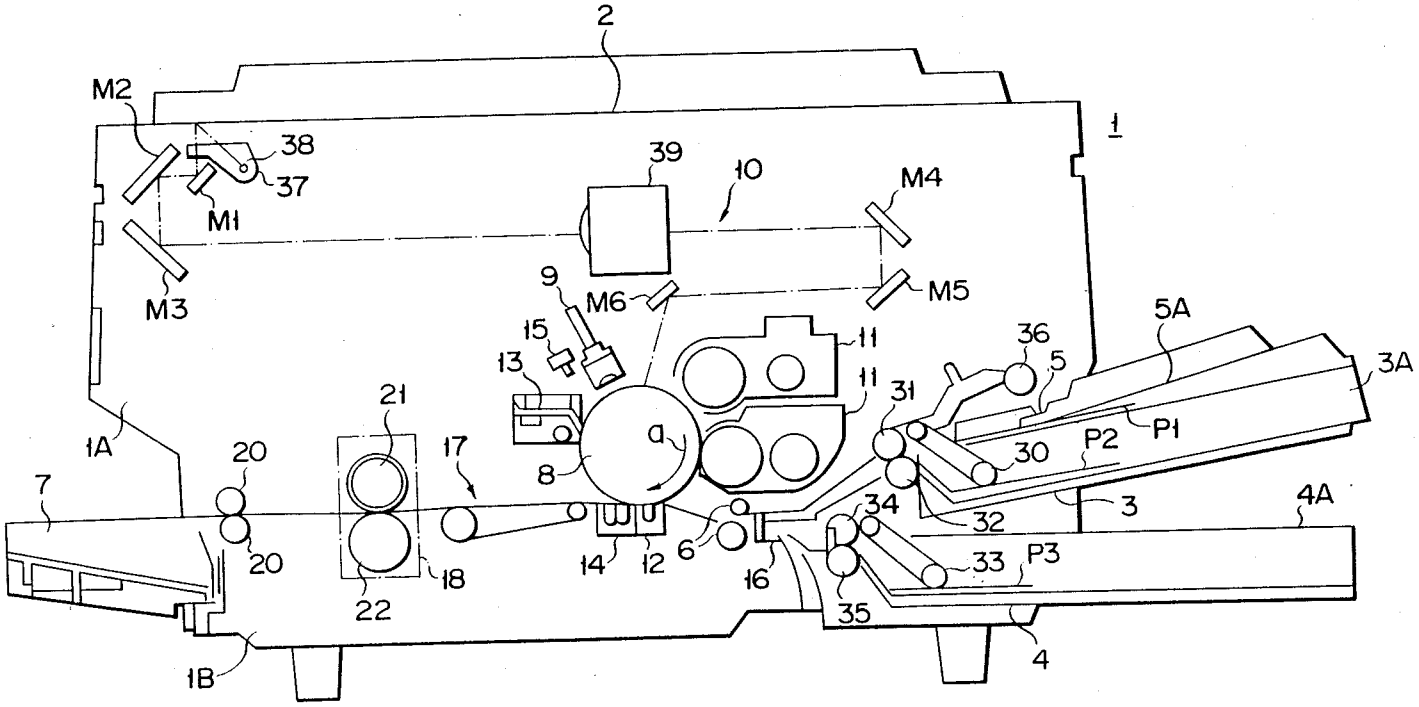
FIG. 1 is a schematic cross-sectional view of an image forming apparatus according to the first embodiment of this invention.

FIG. 1 is a schematic cross-sectional view illustrating an image forming apparatus (hereinafter referred to as copying machine) according to the first embodiment of this invention. An original document stand 2 is provided on the top of a copying machine main body 1, hereinafter referred to as the main body. An upper sheet cassette section 3 and a lower sheet cassette section 4 are provided as a sheet feeding section on the right side of main body 1, and an upper sheet cassette 3A and a lower sheet cassette 4A are respectively loaded in the sections 3 and 4. A cassette cover of upper sheet cassette 3A serves as a manual sheet feeding stand 5A for manually feeding a copying sheet P1, and it is also referred to as a manual sheet feeding section 5. A copying sheet fed out from each sheet feeding section is sent to a pair of resist rollers 6. A sheet tray 7 for receiving a discharged sheet is mounted at the left side of main body 1.

The interior of main body 1 will now be explained. A photosensitive drum 8 is provided substantially at the center of main body 1. Around this drum 8 lie a charger 9, an optical system 10, developer units 11, a transfer charger 12, a separation charger 14, a cleaning device 13 and a de-electrifying lamp 15. A sheet conveying passage 17 is formed under photosensitive drum 8 to guide copying sheets P1, P2 and P3 to sheet tray 7 from a paper stop switch 16. Along this passage 17 lie paper stop switch 16, resist roller pair 6, transfer charger 12, separation charger 14, a thermal fixing section 18, a pair of discharging rollers 20 and sheet tray 7 in the named order from the upper stream. The thermal fixing section 18 comprises a heat roller 21 and a pressure roller 22, which are respectively disposed above and under sheet conveying passage 17. Heat roller 21 and pressure roller 22, when rotated, hold a copying sheet and feeds it to the downstream while thermally fixing a toner image on the copying sheet.

The aforementioned, individual sheet feeding sections are provided in the previous stage of sheet conveying passage 17. Upper sheet cassette section 3 serves to feed a copying sheet P2, retained in upper sheet cassette 3A, to sheet conveying passage 17, and it includes a pickup roller 30, a feed roller 31 and a separation roller 32, the first roller 30 closer to upper copying sheet 3A. Lower copying sheet section 4 serves to feed a copying sheet P3, retained in lower copying sheet 4A, to sheet conveying passage 17, and includes a pickup roller 33, a feed roller 34 and a separation roller 35, the first roller 33 closer to lower copying sheet 4A. Manual sheet feeding section 5 is for supplying a copying sheet Pl, placed on manual sheet feeding stand 5A, to feed roller 31 and separate roller 32, and it includes a feed roller 36.

The aforementioned optical system 10 comprises an exposure lamp 38 having its back surrounded by a reflector 37, mirrors Ml to M6 and a lens 39.

Upper and lower frames (not shown) are pivoted at one end section thereof by pivot shafts (not shown) within main body 1, and are designed such that the other end sections of the frames can open at a predetermined angle, e.g., about 30 degrees.

Charging charger 9, optical system 10, exposure lamp 38, developer unit 11, cleaning device 13 and de-electrifying lamp 15 are disposed around photosensitive drum 8 within the upper frame. Original stand 2, upper sheet cassette section 3 and manual sheet feeding section 5 are mounted to the upper frame. These components together constitute an upper unit IA.

Lower sheet cassette section 4, transfer charger 12, separation charger 14, thermal fixing section 18, discharging roller pair 20 and sheet tray 7 are disposed at their proper positions within the lower frame, thus constituting a lower unit IB.

Since main body 1 can be opened, as described above, it is easy to replace various rollers or other components disposed within the main body.

A description will now be given of the operation of the present copying machine with the above arrangement.

In FIG. 1 photosensitive drum 8 is driven by a driving mechanism (not shown) in the direction of the arrow a in synchronism with optical system 10. When a copying operation starts, photosensitive drum 8 is uniformly charged by charger 9. Then, an original is irradiated with light from exposure lamp 38. The optical system forms an image of the original, as projected by scattered light, on photosensitive drum 8. Developer unit 11 uses a toner to develop an electrostatic latent image on photosensitive drum 8. The toner image thus formed on photosensitive drum 8 is subjected to a transfer process to be transferred onto a copying sheet by transfer charger 12. In the above copying operation, images may be consecutively copied on the same side of a single copying sheet P, and this particular copying is called "multicopying." Images may also be copied on the top and back of the same copying sheet P, and this copying is called "double-side copying."

Copying sheet P1, P2 or P3 (hereinafter referred to feeding section is conveyed for the next, transfer process executed by rotation of resist roller pair 6. The start of the rotation of resist roller pair 6 is controlled through sequence control when paper stop switch 16 is turned ON. This sequence control permits the toner image on photosensitive drum 8 to be in synchronism with copying sheet P.

Transfer charger 12 transfers the toner image on photosensitive drum 8 onto copying sheet P that has been supplied to the transfer process. The copying sheet P having the toner image transferred thereon is separated from photosensitive drum 8 by separation charger 14, and is then guided to thermal fixing section 18. The toner image on copying sheet P is melted and fixed thereon by thermal fixing section 18, and is led to discharging roller 20 through which the sheet P is discharged on sheet tray 7.

Figure 3:
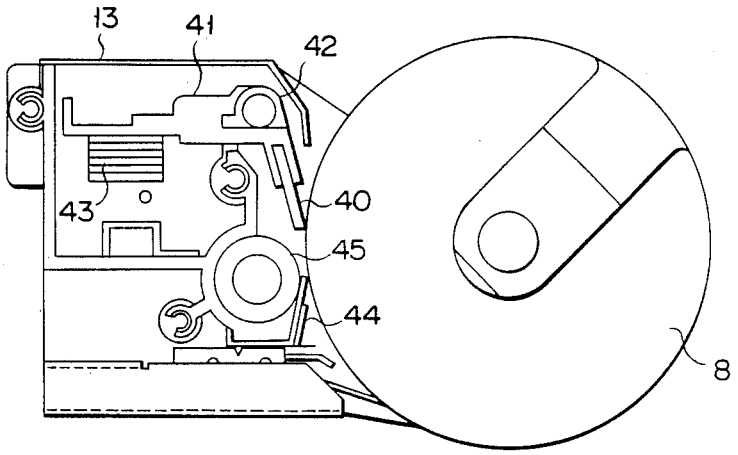
FIG. 3 is a side view of a cleaning device used in the image forming apparatus shown in FIG. 1.

Toner remaining on photosensitive drum 8 even after the transfer of the toner image on copying sheet P from the drum 8 is cleaned by cleaning device 13. A residual image of charges on photosensitive drum 8 is eliminated by de-electrifying lamp 15 to be ready for the next copying operation. For further details of the cleaning operation done by cleaning device 13 used in the present copying machine, FIG. 3 is given which is a cross-sectional view of cleaning device 13 and photosensitive drum 8. Cleaning device 13 is constituted as follows. A cleaning blade 40 is held at one end of a supporting member 41 so as to be slid and abut on photosensitive drum 8. Supporting member 41 is provided rockable around a supporting shaft 42, and it has the other end provided with a load 43, so that downward force is applied to this end portion and upward force is thus applied to cleaning blade 40. Removed toner receiving section 44 is provided below cleaning blade 40 to receive a toner T removed or scraped off by the blade 40. A spiral screw 45 is provided rotatively at that place in removed toner receiving section 44 where toner T is recovered.

Figure 4:
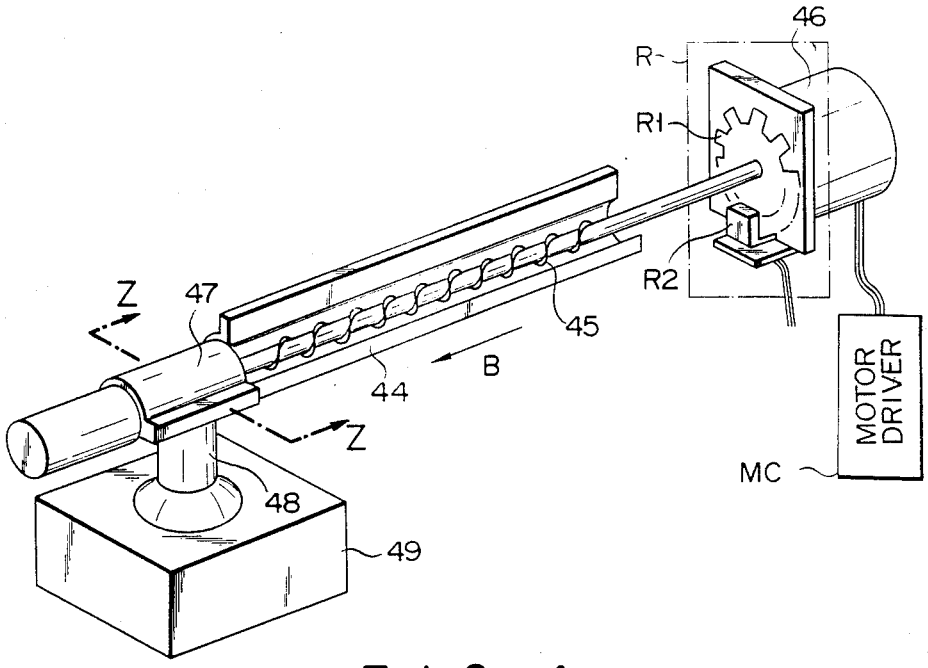
FIG. 4 is a perspective view illustrating a pulse motor, an encoder having a photointerrupter, a conveying screw and a developer collecting box, which are used in a cleaning device shown in FIG. 3.

FIG. 4 is a perspective view of cleaning device 13 used in the present copying machine. As illustrated in FIG. 4, screw 45 has its one end coupled to a pulse motor 46 and the other end coupled to a toner discharging pipe 47. A motor driver MC is provided below pulse motor 46 in the same diagram. Pulse motor 46 is provided with an encoder R which is constituted by a disk R1 and a photointerrupter R2. A discharging port 48 is formed at the bottom of discharging pipe 47, and a toner collecting unit 49 is provided further below the port 48. Toner T recovered in toner receiving section 44 is carried through discharging pipe 47 in the direction of the arrow B in FIG. 4 by the rotation of screw 45 driven by pulse motor 46. The toner T is moved through discharging port 48 and is collected in toner collecting unit 49.

Figure 5:
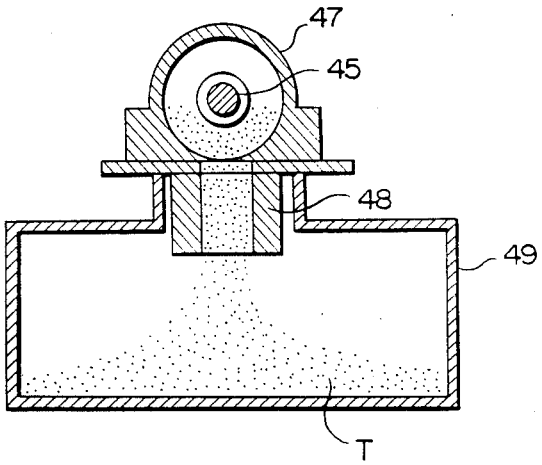
FIG. 5 is a cross-sectional view of a discharging pipe and the developer collecting box used in the cleaning device shown in FIG. 3.

FIG. 5 is a cross-sectional view of discharging pipe 47 and toner collecting unit 49 of FIG. 4 as taken along the line Z—Z' and viewed in the direction of the arrow B. As illustrated, discharging pipe 47 is fitted in the receiving opening of toner collecting unit 49 in order to prevent the removed toner T from leaking from the pipe 47. When the collected toner T fills the toner collecting unit 49, it will remain in discharging port 48 and further in discharging pipe 47. Meanwhile, toner T, removed by cleaning blade 40, is sequentially supplied to discharging pipe 48, so that the toner T gets condensed to thereby burden screw 45 with a load. This load on screw 45 disturbs the driving of pulse motor 46. This disturbance is detected by the output pulse width of encoder R being greater than the normal output pulse width. (This will be described later.) At this time, screw 45 does not move in the thrust direction, so that toner T does not come out of toner receiving section 44.

Figure 2:
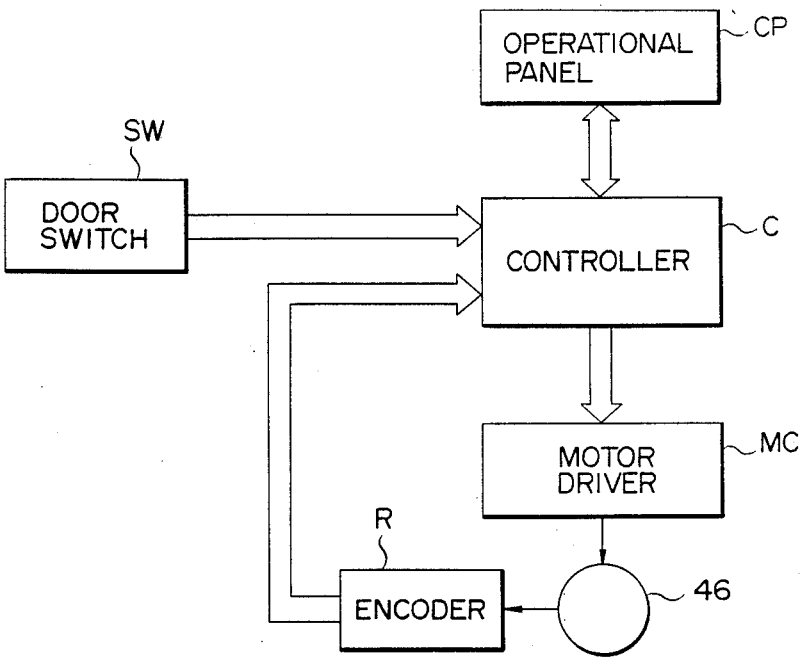
FIG. 2 is a block diagram of a control system for the image forming apparatus shown in FIG. 1.

FIG. 2 is a block diagram which illustrates a Control system for detecting that toner collecting unit 49 is full of collected toner T. A controller C, which is constituted by a microcomputer, etc., is located at the center in the diagram. The input section of controller C is electrically coupled with an operational panel CP, a door switch SW and encoder R. The output section of controller C is electrically coupled with operational panel CP and a motor driver MC whose output section is electrically a pulse motor M provided with the encoder R. The operation of this control system will be described in detail later.

FIG. 6 illustrates the detailed circuit configuration of motor driver MC shown in FIG. 2. In FIG. 6, input terminals IA, IB, IA', and IB' are coupled to the input terminals of drivers D1 to D4 whose output terminals are coupled through a pull-up resistor PU to one end of a base current control resistor BU. Pull-up resistor PU is coupled to a power source 0 (e.g., +5 V), and base current control resistor BU has the other end coupled to the bases of transistors TR1 to TR4 and the input terminals of Zener diodes ZD1 to ZD4. Zener diodes ZD1-ZD4 serve to protect transistors TR1-TR4. Transistors TR1-TR4 have their emitters coupled to a power source 01 (e.g., +24 V) through the respective coils AC, BC, AC and BC and also coupled to Zener diodes ZD1–ZD4. The collectors of transistors TR1–TR4 are grounded.

Input terminals IA, IB, IA', and IB' are respectively supplied with excitation signals shown in FIGS. 7A to 7D from controller C. Coils AC, BC, $\overline{AC}$ and $\overline{BC}$ are excited in this manner to thereby drive pulse motor 46.

Figure 8:
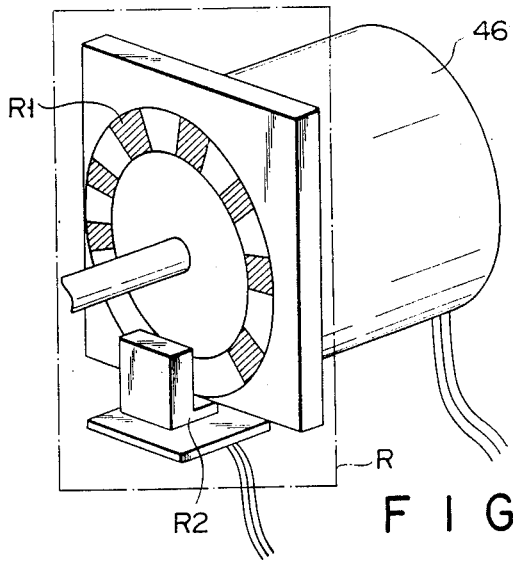
FIG. 8 is an enlarged view illustrating the structures of the encoder and pulse motor shown in FIG. 4.

The structure of encoder R will be described below, referring to FIG. 8 which is a perspective view of pulse motor 46 and encoder R. As mentioned earlier, encoder R is constituted by disk R1 and photointerrupter R2. The disk R1 has its center secured to the rotary shaft of pulse motor 46, and is rotated by the rotation of pulse motor 46 in the same rotational direction. Forty eight plates are formed a teeth along the periphery of disk R1; the shaded sections in FIG. 8 are those plates. Photointerrupter R2 has a U-shape and has disk R1 immovably fitted at the recessed section.

A description will now be given of the operation of thus constituted encoder R.

When motor driver 4 drives pulse motor 46 using the mentioned excitation signals, disk R1 of encoder R rotates accordingly. Since, as described above, disk R1 has 48 plates formed in the form of teeth on its periphery, photointerrupter R2 outputs a signal in association with these 48 plates of disk R1.

Figure 9:
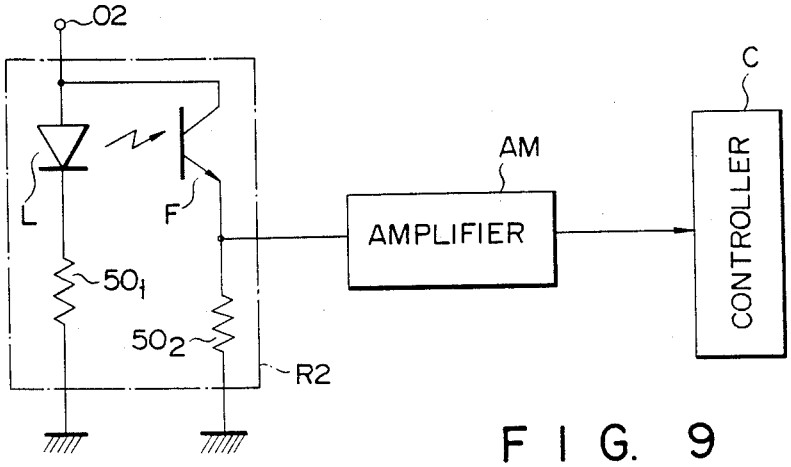
FIG. 9 is a circuit diagram of the photointerrupter shown in FIG. 4.

FIG. 9 is a circuit diagram of photointerrupter R2. This photointerrupter R2 is constituted by a light emitting diode L and a photoelectric converting element F. The output power of light emitting diode L is controlled by resistor 501, one end of which is connected to the cathode of photodiode L and the other grounded. The emitter of photoelectric converting element F is grounded through resistor 502. Photointerrupter R2 is powered by a power supply 02. The output section of photointerrupter R2 is electrically coupled to the input section of controller C through an amplifier AM.

Figure 10:
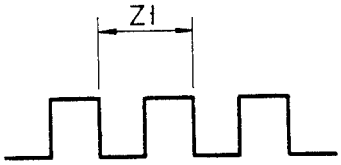
FIG. 10 is a waveform diagram of signals from the photointerrupter shown in FIG. 9.

The teeth of disk R1 are fitted between photodiode L and photoelectric converting element F of photointerrupter R2, so that the rotation of disk R1 causes photointerrupter R2 to provide its output signal. When the teeth of disk R1 shield light from photodiode L, photoelectric converting element F is turned OFF, and when the teeth do not shield the light from photodiode L and permit this light to pass between them, photoelectric converting element F is turned ON. When photoelectric converting element F does not have an output, the output of photointerrupter R2 has a "LOW" level, while when the element F has an output, the output of photointerrupter R2 has a "HIGH" level. The output of photointerrupter R2 is wave-shaped by amplifier AM to have a waveform as shown in FIG. 10. Controller C (FIG. 2) compares the cycle Z1 of the pulse attained from amplifier AM with the pulse cycle Z2 of excitation signal output to motor driver 4 from controller C. When both pulse widths equal each other during a copying operation, controller C determines that toner collecting unit 49 is not full of toner yet and continues the copying operation. When the two pulse cycles do not equal each other and their ratio becomes, for example, 4/3 times the normal ratio, controller C determines that toner collecting unit 49 has filled up with toner T and the driving of pulse motor 46 is disturbed. Then, controller C stops the supply of the excitation signal and stops the copying operation at the same time, as well as causes operational panel CP of FIG. 2 to display that toner collecting unit 49 is full of toner T. In this way, the amount of toner T collected in collecting unit 49 can be electrically monitored.

Figure 11:
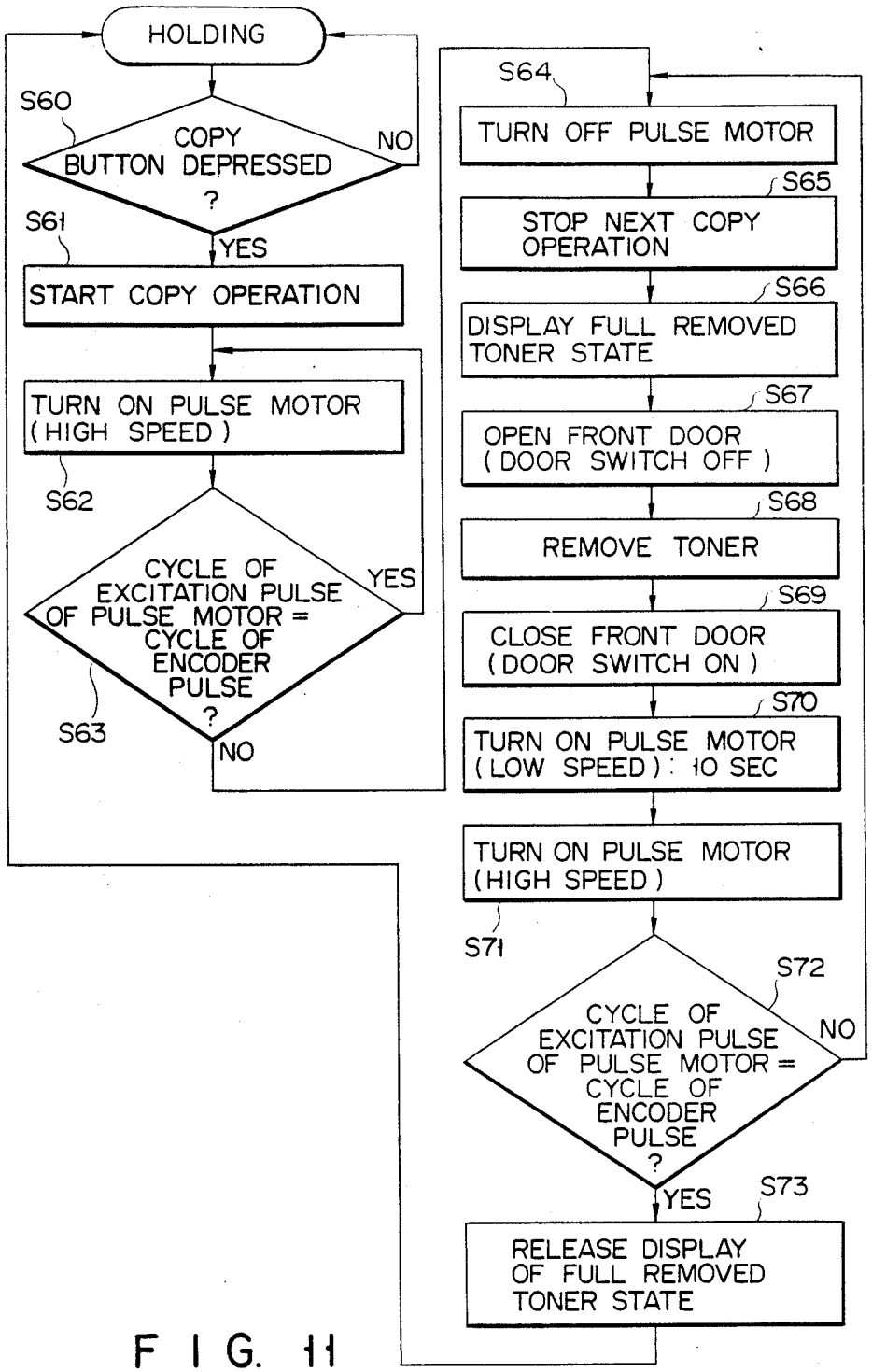
FIG. 11 is a flowchart for explaining the operation of detecting that the collecting box is full of residual developers.

Referring now to the flowchart of FIG. 11, a description will be given of how the present copying machine with the above arrangement detects that toner collecting unit 49 is full of toner T.

When the present copying machine is in the holding mode after the warming up of main body 1 is completed, the flow advances to step 60. In this step, it is determined whether or not a copy button on operational panel CP has been depressed to thereby determine if the copying operation should be started. If the copy button has not been depressed, the copying machine maintains the holding mode. But, when the depression of the copy button is detected, the flow advances to step 61.

In step 61, the individual units in main body 1 are driven to start the copying operation. The flow then advances to step 62 where a high-speed drive signal is supplied to pulse motor 46 serving to drive screw 45 in order to cause screw 45 to carry toner T, removed from photosensitive drum 8 by cleaning blade 40 of cleaning device 13, to toner collecting unit 49. In the next step 63, controller C determines whether or not the cycle Z2 of the excitation pulse of pulse motor 46 equals the cycle Z1 of the output pulse of encoder R (for example, whether or not the cycle Z2 is 4/3 times the pulse cycle Z1 attained in the normal state) in order to detect that toner collecting unit 49 is full of toner T. This determination is made by counting how many reference clocks come within the cycle Z2 of the excitation pulse and the cycle Z1 of the output pulse of encoder R using, for example, a counter, and then comparing both counted values with each other. When both cycles are determined to equal each other, the flow returns to step 62, and when the decision is otherwise, the flow advances to step 64. In step 64 the supply of the drive signal to pulse motor 46 is stopped and pulse motor 46 stops rotating accordingly. In the subsequent step 65, the next copying operation is stopped. The flow then advances to step 66 where operational panel CP displays that toner collecting unit 49 is full of removed toner. In the subsequent step 67, the front door is opened to dispose of toner T in toner collecting unit 49, and this action turns door switch SW OFF. The flow then advances to step 68 where the removed toner collected in toner collecting unit 49 is disposed. In the next step 69 the front door is closed and door switch SW is turned ON accordingly; the flow then advances to step 70.

In step 70 pulse motor 46 is driven for 10 seconds for low-speed warm-up. In the next step 71 pulse motor 46 starts rotating at a high speed as described earlier, and the flow advances to step 72 where controller C again determines whether or not the cycle Z2 of the excitation pulse to pulse motor 46 equals the cycle Z1 of the output pulse of encoder R. If the decision is negative, it is determined that disposal of the removed toner is not completed yet and the flow returns to step 64. If the decision in step 72 is affirmative, the flow advances to step 73 where the display of the full toner status on the display section of operational panel CP is released and the copying machine enters the holding mode. In this way, the amount of toner T can be electrically monitored.

The copying machine with the above arrangement does not need such an element as a photosensor which should not be stained even partially, and is therefore effective in dealing with such a material as toner that is likely to stain the maChine.

The present invention is not restricted to the above embodiment; for example, plates disposed on the disk of the encoder in the form of teeth may be provided with magnets and a reference signal is acquired by a Hall element.

According to the first embodiment, as described above, a toner does not leak while a residual toner is carried to a toner collecting unit, and the toner-full status can be detected stably at a preset level so that a user can properly be informed of such a status.

The second embodiment of this invention will now be described referring to the remaining drawings.

Figure 12:
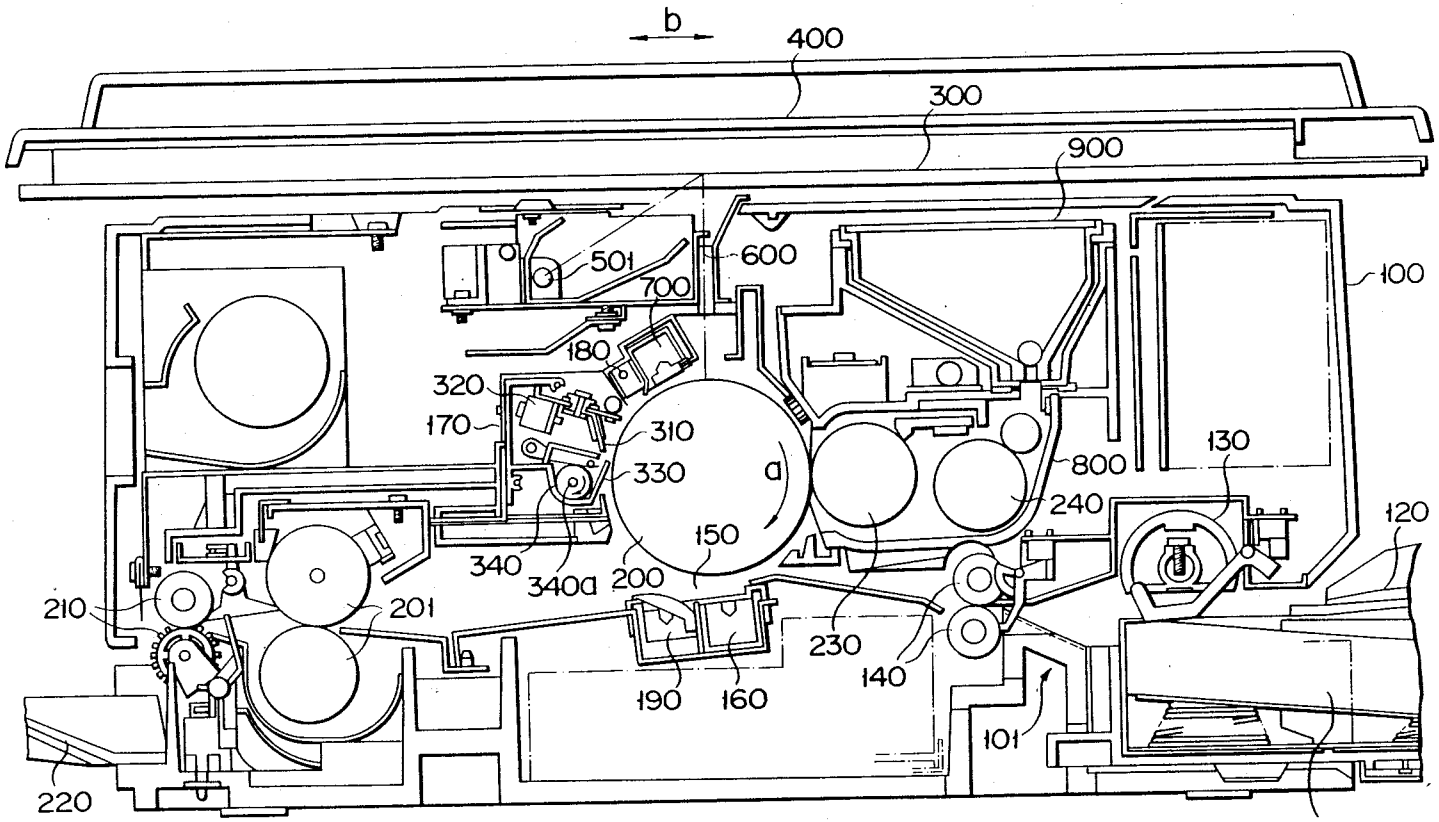
FIG. 12 is a side cross-sectional view illustrating the structure of an image forming apparatus according to the second embodiment of this invention.

FIG. 12 schematically illustrates an image forming apparatus (referred to as a copying machine) according to the second embodiment of this invention. Reference numeral 100 denotes a casing; a photosensitive drum 200 that rotates in the direction of the illustrated arrow a is provided as an image carrier at substantially the center of casing 100. An original document stand (transparent glass) 300 on which an original is to be placed is provided on the top of casing 100 in a reciprocative manner in the direction of the illustrated arrow b. An original cover 400 is provided on original stand 300 and is openable. As original stand 300 moves in synchronism with the rotation of photosensitive drum 200, light irradiated from exposure lamp 501 is reflected by the original placed on original stand 300. The reflection light is led on photosensitive drum 200 by a Condensing light transmitting body 600 and it appears as an inverted image of the original on the drum. By charging the surface of photosensitive drum 200 by means of a charger 700 at this time, the inverted image of the original is formed as an electrostatic latent image on photosensitive drum 200. This latent image is developed by supplying a toner on the drum by means of a developer unit 800. This developer unit 800 includes a plurality of developer units 230 and 240 and is detachable to casing 100. These developer units 230 and 240 contain developers of different colors which are prepared in advance, so that the desired colored developer can be selected from different developer units. The attachment/detachment of developer unit 800 to casing 100 can be done by opening a lid 900 provided openable on the top of casing 100.

A sheet feeder 101 for feeding a sheet under photosensitive drum 200 (to an image transfer section 150) is provided at the lower right portion of casing photosensitive drum 200 that rotates in the direction cassette 110, which is detachably mounted to the right side portion of casing 100 and contains a plurality of sheets (image recording mediums), a manual sheet feeding stand 120 provide at the upper portion of sheet cassette 110 for manual feeding of a sheet, and a feed roller 130 for feeding sheets from sheet cassette 110 one at a time. Sheet feeder 101 further has aligning rollers 140, which temporarily stops the supply of a sheet fed out by feed roller 130 or a sheet manually fed, corrects the inclination of the leading edge of that sheet and supplies the sheet to image transfer section 150 at such a timing that the leading edge of the sheet coincides with the leading edge of the toner image on photosensitive drum 200.

The sheet fed to image transfer section 150 by aligning rollers 140 is charged by a transfer charger 160, so that when that portion of the sheet above transfer charger 160 comes in close contact with the surface of photosensitive drum 200, the toner image on the drum 200 is transferred on the sheet. Photosensitive drum 200 after the image transfer has a residual toner on its surface, and this residual tone is removed by a cleaning device (cleaner) 170. In addition, photosensitive drum 200 has a residual image eliminated from its surface by a de-electrifying lamp 180 to be in an initial state.

The image-transferred sheet is separated from photosensitive drum 200 by a separation charger 190 and is guided to a fixing unit 201. The sheet passing through this fixing unit 201 is applied with heat and pressure so that the toner image is thermally fixed on the sheet. The image-fixed sheet is discharged by a discharge roller pair 210 onto a tray 220 outside casing 100. Reference numeral 230 denotes a cooling fan for preventing the temperature from rising in casing 100.

Figure 14:
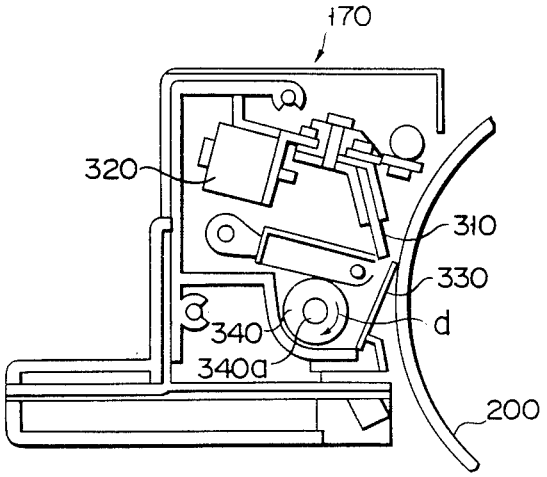
FIg. 14 is a diagram illustrating an essential section of the cleaning device used in the image forming apparatus shown in FIG. 12.

FIG. 14 illustrates cleaning device 170 used in the second embodiment of this invention.

Figure 15:
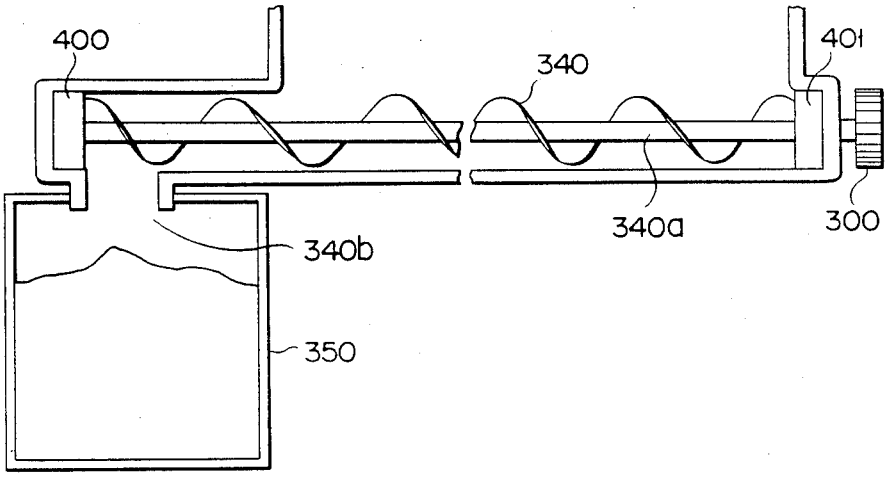
FIG. 15 is a cross-sectional view of the cleaning device shown in FIG. 14.

A main blade 310 for removing a toner is pressed against photosensitive drum 200 by a weight 320 so that any toner remaining on photosensitive drum 200 after image transfer is scraped off the drum by main blade 310. The removed toner is carried to a spiral toner collecting auger 340 by a recovery blade 330. As shown in FIG. 15, this toner collecting auger 340 is rotated in the direction of the illustrated arrow d (FIG. 14) by transmitting the rotational moment of a motor 450 (FIG. 13) to a gear 300. The rotation of toner collecting auger 340 causes the removed toner to be carried toward the front side and to be discharged through a discharging port **340*b*. The waste tone is finally collected in a toner box 350 (FIG. 15**).

As shown in FIG. 15, toner collecting auger 340 has bearing sections 400 and 401 of its auger shaft **340*a* fixed by the respective ball bearings (not shown). Accordingly, the rotational moment of the motor 450 (FIG. 13) is transmitted to gear 300 which in turn rotates in the direction of the arrow d shown in FIG. 14**.

As a result, auger shaft **340*a* does not move in the thrust direction, thus ensuring complete sealing of bearing sections 400 and 401**.

Figure 13:
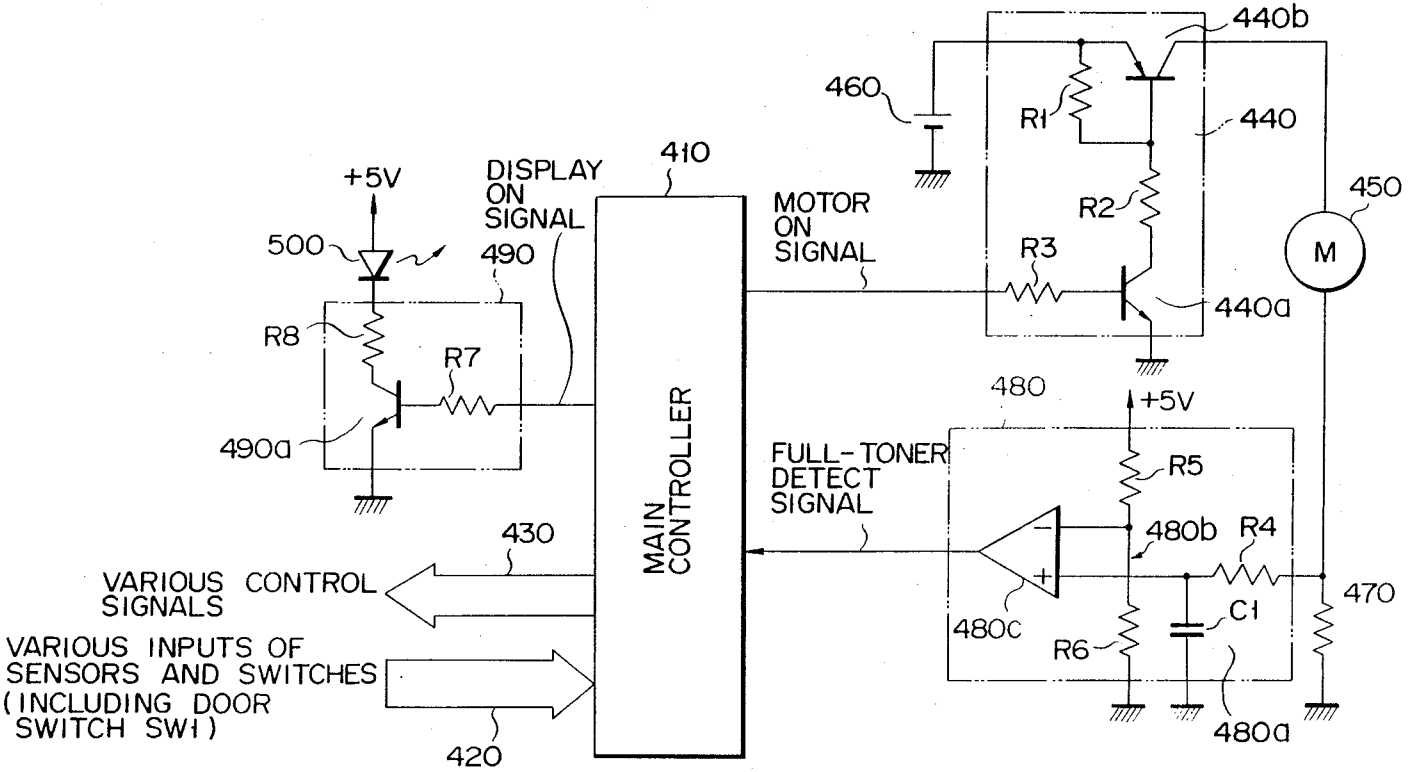
FIG. 13 is a diagram illustrating the controller and detector of the image forming apparatus shown in FIG. 12.

FIG. 13 illustrates a controller used in the second embodiment of this invention. A main controller 410 executes the general control of the copying machine and is constituted mainly by a microprocessor, for example. Main controller 410 has an output port 430 for outputting various control signals to control the motor, solenoid and lamp (all not shown) and an input port 420 for receiving signals from a sensor (not shown) and switches (including a door switch SW1).

Main controller 410 is coupled to a driver 440, a full-toner detector 480 and an energizing circuit 490. The driver 440 drives a DC motor 450 to rotate toner collecting auger 340 (FIG. 15). The full-toner detector 480 detects toner box 350 being full of a toner by detecting the driving force of DC motor 450 through a resistor 470 coupled in series to the DC motor 450 to generate a voltage proportional to the output current of DC motor 450. The energizing circuit 490 controls the activation of a full-toner indicator (constituted by an LED) 500 which is energized upon reception of a fulltoner detect signal from full-toner detector 480.

Motor driver 440 comprises an NPN type transistor **440*a*, which is turned ON by a motor ON signal ("H" level) from main controller 410, a PNP type transistor 440*b*, which applies the drive voltage of a power source 460 to DC motor 450**, and resistors R1, R2 and R3.

Full-toner detector 480 comprises a low-pass filter **480*a*, a series circuit 480*b* and a comparator 480*c*. The low-pass filter 480*a* is constituted by a capacitor C1 and a resistor R4 in order to remove the instantaneous noise of the voltage of resistor 470. The series circuit 480*b* is constituted by resistors R5 and R6, and generates a reference voltage. The comparator 480*c* compares the voltage supplied through low-pass filter 480*a* with the reference voltage from the series circuit 480*b* to detect if the former voltage has reached the latter one. When the voltage generated by resistor 470 reaches the reference voltage generated by series circuit 480*b*, comparator 480*c* sends to main controller 410 the full-toner detect signal ("H" level) which represents that toner box 350 is full of the toner. In this way, the amount of the toner collected in toner box 350** can be electrically monitored.

The aforementioned energizing circuit 490 is constituted by an NPN type transistor **490*a* and resistors R7 and R8; NPN type transistor 490*a* is turned ON in accordance with the display ON signal ("H" level) from main controller 410**.

The operation of the main controller will now be described. When the motor ON signal from main controller 410 becomes a "H" level, transistors **440*a* and 440*b* constituting motor driver 440 are turned ON to thereby apply the voltage from power source 460 to the series circuit constituted by DC 450 and resistor 470**.

As a result, DC motor 450 rotates and its rotational force is transmitted through gear 300 to toner collecting auger 340 to rotate this auger (refer to FIG. 15). Accordingly, the rotation of toner collecting auger 340 causes the residual toner, scraped off photosensitive drum 200 by main blade 310, to be carried as a waste toner to discharging port **340*b*. The residual toner is then collected in toner box 350 through discharging port 340*b***.

When toner box 350 becomes full of the collected toner, the waste toner will adhere to the left end (see FIG. 15) of toner collecting auger 340. This increases the rotational torque of toner collecting auger 340 on DC motor 450. Consequently, the current flowing through DC motor 450 and resistor 470 increases in proportion to the rotational torque, so that the voltage generated by resistor 470 gets greater than the reference voltage of series circuit **480*b*. Accordingly, the full-toner detect signal sent to main controller 410 from comparator 480*c* changes its level to "H" from "L." In response to the level change, main controller 410 stops the copying operation and sets the display ON signal to have the "H" level to turn on transistor 490*a*. As a result, a fulltoner indicator 500 is turned ON to indicate that toner box 350** is full of a toner.

Figure 16:
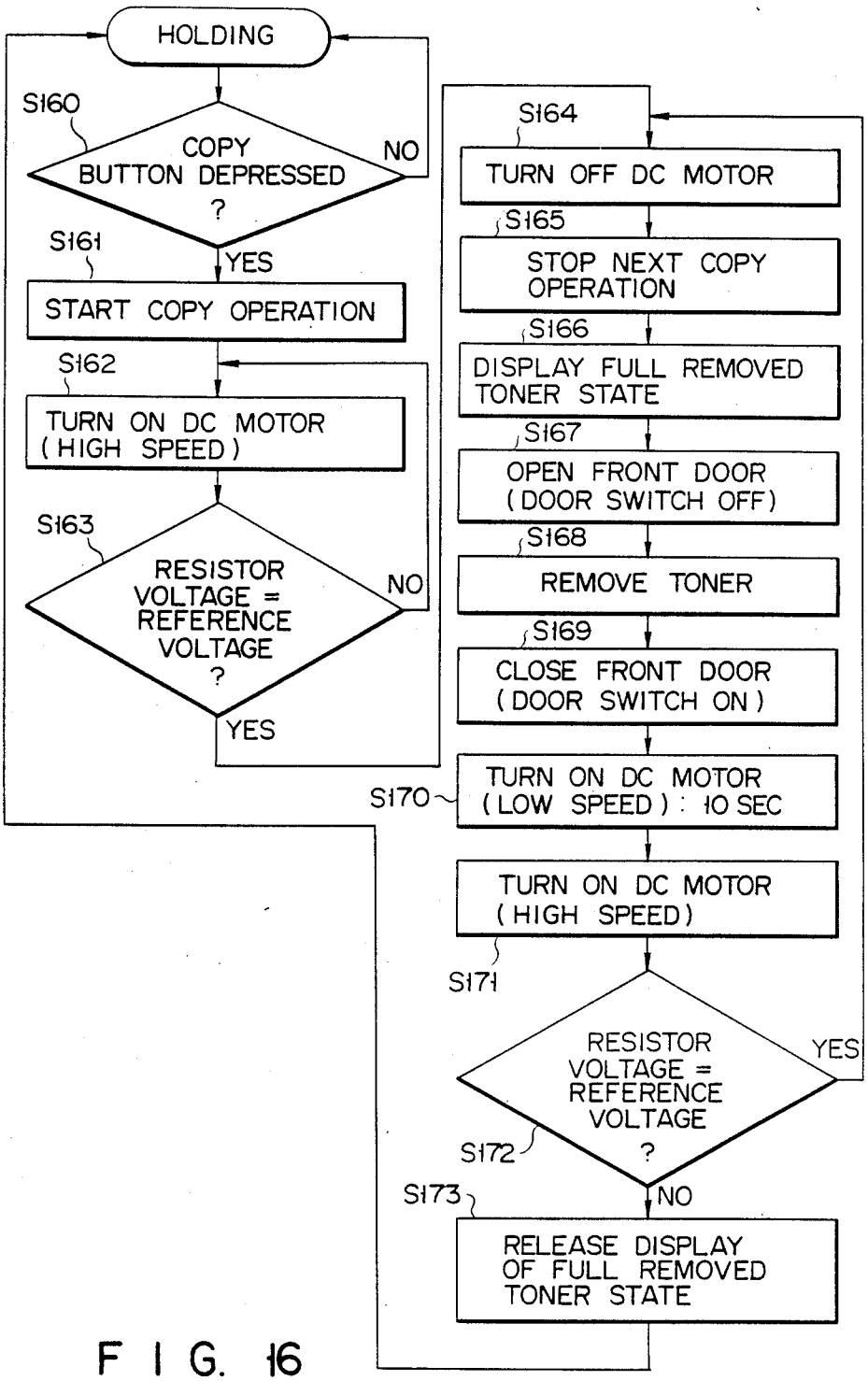
FIG. 16 is a flowchart for explaining the operation for detecting that the collecting box in the image forming apparatus shown in FIG. 12 is full of residual developers.

Referring now to the flowchart of FIG. 16, a description will be given of how the copying machine according to the second embodiment detects toner box 350 being full of the collected toner.

When the present copying machine is in the holding mode after warming up casing 100 is completed, the flow advances to step 160. In this step, it is determined whether or not a copy button on an operational panel (not shown) has been depressed to thereby determine if the copying operation should be started. If the copy button has not been depressed, the copying machine maintains the holding mode. But, when the depression of the copy button is detected. the flow advances to step 161.

In step 161, the individual units in casing 100 are driven to start the copying operation. The flow then advances to step 162 where a motor ON signal is supplied to motor driver 440 to drive DC motor 450 at a high speed in order to cause toner collecting auger 340 to carry toner T, removed from photosensitive drum 200 by main blade 40 of cleaning device 170, to toner box 350. In the next step 163, comparator **480*c* compares the voltage generated by resistor 470 with the reference voltage generated by series circuit 480*b* to detect whether or not the former voltage has reached the latter. When the former voltage has not reached the reference voltage, the flow returns to step 162, and when the former has reached the latter, the flow advances to step 164. In step 164 the supply of the motor ON signal to motor driver 440 is stopped and DC motor 450 stops rotating accordingly. In the subsequent step 165, the next copying operation is stopped. The flow then advances to step 166 where indicator 500 indicates that toner box 350 is full of removed toner. In the subsequent step 167, the front door is opened to dispose of the toner in toner box 350, and this action turns the door switch (SW1) OFF. The flow then advances to step 168 where the removed toner collected in toner box 350 is disposed. In the next step 169 the front door is closed and the door switch (SW1) is turned ON accordingly; the flow then advances to step 170**.

In step 170 DC motor 450 is driven for 10 seconds for low-speed warm-up. In the next step 171 DC motor 450 starts rotating at a high speed as described earlier, and the flow advances to step 172 where comparator 480c again checks if the voltage generated by resistor 470 has reached the reference voltage generated by series circuit 480b. If the former voltage has reached the reference voltage, it is determined that disposal of the removed toner is not completed yet and the flow returns to step 164. If the former voltage has reached the reference voltage, the flow advances to step 173 where the display of the full toner status is released and the copying machine enters the holding mode.

As described above, when toner box 350 becomes full of the waste toner and the rotational torque of the toner collecting auger increases, this load increases the current of the DC motor. The full-toner status of the toner box is detected by utilizing this behavior. In this way, the amount of the toner can be electrically monitored.

With this design, it is possible to accurately detect the full-toner status of the toner box with a simple structure. In addition, since the auger shaft of the toner collecting auger does not move in the thrust direction, the toner collecting auger can be provided with a high air-tightness so that the removed toner can be prevented from leaking outside.

Although according to the second embodiment, the DC motor drives only the toner collecting auger, this embodiment is not restricted to this particular arrangement; the DC motor may serve to drive the photosensitive drum as well.

Figure 17:
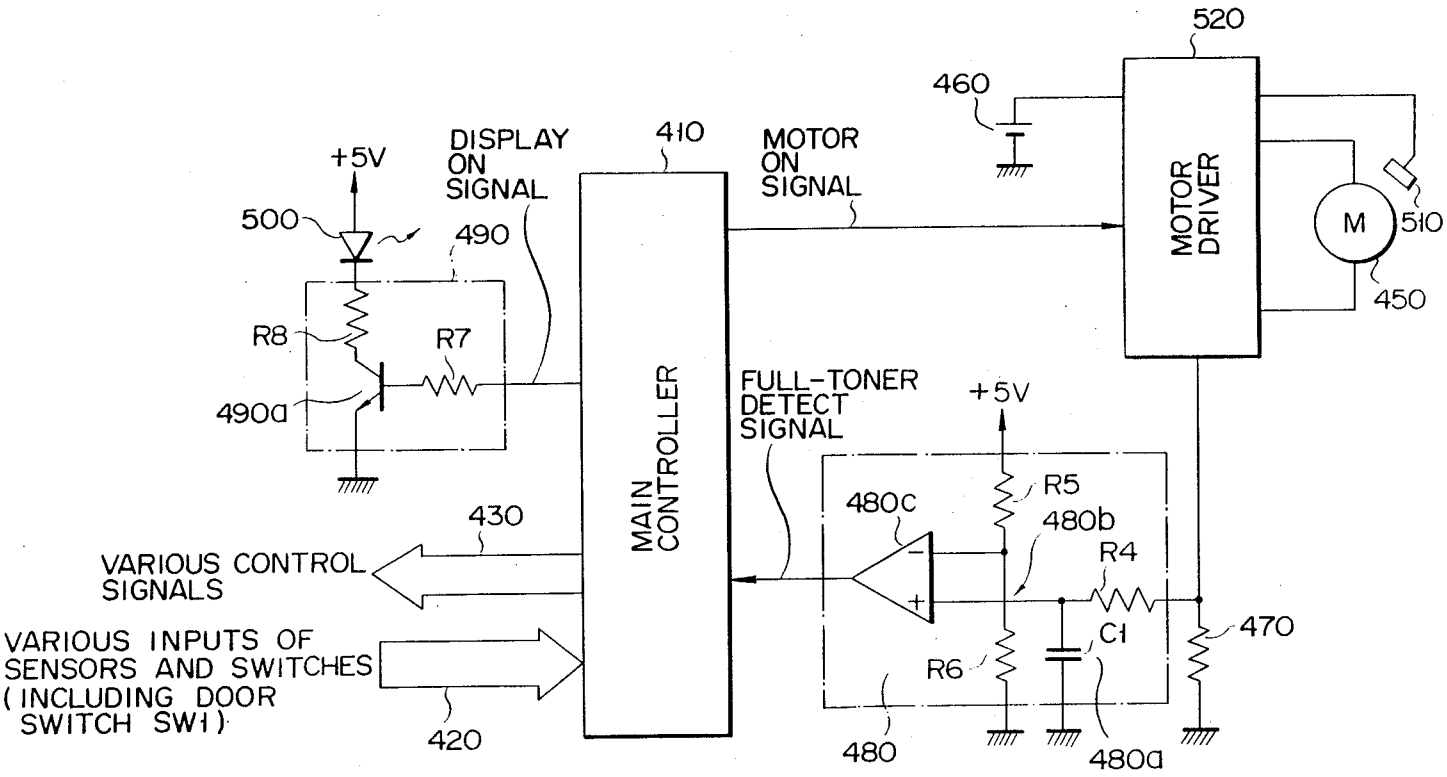
FIG. 17 is a diagram illustrating a modification of the image forming apparatus shown in FIG. 12.

For instance, as shown in FIG. 17, because of stable rotation of photosensitive drum 200 required, DC motor 450 is provided with a rotational speed sensor 510 and the speed control of DC motor 450 is executed by motor driver 520 in accordance with the output of sensor 510. In &his case, it is necessary that the detection level of the load torque generated by the full-toner state be set higher than a variation in torque between the main blade and photosensitive drum, or the full-toner state would b erroneously detected through this variation even if the toner box is not full of the toner yet.

As described above, this invention can provide a cleaning device which, with a simple structure, can accurately detect the full-toner status in a toner box and ensures air-tightness to prevent a toner from leaking outside.

What is claimed is:

1. A developer cleaning apparatus for an image forming apparatus, comprising:

an image carrier;

means for removing excess developer from the image carrier;

means from receiving the removed excess developer;

means for transporting the developer received in said receiving means in a direction away from the removing means;

a pulse motor for driving said transporting means;

means for detecting the amount of developer in said receiving means so as to output information indicative of such amount of developer, said detecting means detecting the amount of developer from the torque generated by said pulse motor; and means for monitoring the amount of developer received by the receiving means in response to the information from said detecting mans.

2. The apparatus of claim 1, wherein the transporting means includes a spiral screw received in said receiving means and coupled to said pulse motor so as to be rotated thereby.

3. The apparatus of claim 1, wherein the detecting means outputs the information by comparing the torque with a predetermined standard.

4. A developer cleaning apparatus for an image forming apparatus, comprising:

means for removing developer from an image carrier;

means from receiving the removed developer;

means for transporting the developer in a direction away from said receiving means, said transporting means including a spiral shaft disposed in said receiving means, and a pulse motor for providing a driving force to said spiral shaft;

first detecting means for detecting the driving current flowing through said pulse motor; and second detecting means for detecting the amount of developer from the amount of drive current detecting by said first detecting means.

5. A developer cleaning apparatus for an image forming apparatus, comprising:

means for removing developer from an image carrier;

means for receiving the developer removed by said removing means;

means for collecting the removed developer;

means for transporting the developer received in said receiving means to said developer collecting means, said transporting means having a rotatable transporting member disposed in said receiving means and a pulse motor for rotating said rotatable transporting member so as to transport the developer to said collecting means;

means for detecting that said collecting means is filled with the developer, said detecting means including means for detecting the toque of said pulse motor and means for comparing the torque with a predetermined value so as to output a detection signal indicating that the collecting means is filled; and means for terminating said image forming apparatus in response to the detection signal.

6. The apparatus of claim 5, wherein said transporting member includes a helical screw coupled to said pulse motor.

7. The apparatus of claim 5, wherein the detecting means includes means for detecting the motor current flowing through said pulse motor.

8. The apparatus of claim 7, wherein said terminating means terminates operation of said image forming apparatus when the motor current reaches a predetermined value.

9. A developer cleaning method for an image forming apparatus, comprising the steps of:

(a) removing developed from an image carrier of the image forming apparatus;

(b) transporting the removed developer to a collecting unit by means of a motor actuated element driven by a pulse motor;

(c) measuring the torque loading on the motor actuated element from the torque generated by said pulse motor;

(d) comparing the torque loading with a predetermined standard; and (e) terminating the operation of the image forming apparatus if the torque loading equals the predetermined standard, the torque loading being proportional to the amount of removed developer.

10. The method of claim 9, wherein the motor actuated element is a helical screw.

11. A developer cleaning apparatus for an image forming apparatus, comprising:

means for removing developer from an image carrier;

means for receiving the developer removed by said removing means;

means for collecting the removed developer;

means for transporting the developer received in said receiving means to said developer collecting means, said transporting means having a rotatable transporting member disposed in said receiving means and a pulse motor for rotating said rotatable transporting member so as to transport the developer to said collecting means;

means for detecting the torque of said pulse motor;

means for comparing the torque with a predetermined value so as to output a detection signal indicating that said collecting means is filled; and means for terminating said image forming apparatus in response to the detection signal.

* * * * *